United States Patent [19]

Corring et al.

[11] Patent Number: 4,992,212

[45] Date of Patent: Feb. 12, 1991

[54] ALKALINE LIGHT DUTY LIQUID DETERGENTS THAT ARE NON-STAINING TO ALUMINUM

[75] Inventors: Robert J. Corring, Rockaway Township; Vincent Lamberti, Upper Saddle River, both of N.J.; Michael P. Aronson, West Nyack, N.Y.

[73] Assignee: Lever Brothers Company, Division of Conopco, Inc., New York, N.Y.

[21] Appl. No.: 259,072

[22] Filed: Oct. 18, 1988

[51] Int. Cl.[5] ..... C11D 3/04; C11D 1/18; C23F 11/00; C23G 1/18

[52] U.S. Cl. ..... 252/542; 134/26; 134/38; 134/39; 134/40; 252/89.1; 252/133; 252/153; 252/158; 252/173; 252/389.52; 252/390; 252/546; 252/548; 252/553; 252/DIG. 14; 422/13

[58] Field of Search ..... 134/38, 39, 40, 26; 252/89.1, 133, 153, 546, 548, 559, 173, 542, 158, 389.52, 390; 422/13

[56] References Cited

U.S. PATENT DOCUMENTS

| | | | |
|---|---|---|---|
| 3,663,445 | 5/1972 | Augustin | 252/117 |
| 3,715,324 | 2/1973 | Hynes | 252/529 |
| 4,002,571 | 1/1977 | Anderle | 252/90 |
| 4,056,113 | 11/1977 | Johnson | 134/40 |
| 4,069,066 | 1/1978 | Hindle | 134/6 |
| 4,070,309 | 1/1978 | Jacobsen | 252/547 |
| 4,145,303 | 3/1979 | Loudas | 252/156 |
| 4,164,477 | 8/1979 | Whitley | 252/99 |
| 4,285,840 | 8/1981 | Fricker | 252/546 |
| 4,297,251 | 10/1981 | Bernardino | 252/545 |
| 4,578,208 | 3/1986 | Geke | 252/135 |

*Primary Examiner*—Dennis Albrecht
*Attorney, Agent, or Firm*—A. Kate Huffman

[57] ABSTRACT

Liquid light duty cleaning compositions comprise an organic base (such as amines), a zinc salt (such as zinc halides or zinc citrate), and a complexing agent (such as EDTA). The compositions are useful in cleaning both at full strength and when diluted and do not cause staining of treated aluminum utensils.

4 Claims, No Drawings

ALKALINE LIGHT DUTY LIQUID DETERGENTS THAT ARE NON-STAINING TO ALUMINUM

SCOPE OF INVENTION

The present invention relates to liquid cleaning compositions comprising an organic base, an anionic surfactant, a zinc salt and a complexing agent. Such compositions are useful both for light duty domestic cleaning of dishware and utensils and heavier duty cleaning of cooked-on foods on cookware.

BACKGROUND OF THE INVENTION

It has been known that certain types of alkaline cleaners are effective compositions for "pretreating" soiled pots, pans, plates and other eating utensils. These cleaners are applied to the utensils after use and allowed to remain on the utensils for from 5, preferably from 10 minutes, to about 1 hour. After this pretreatment, food soils are easily removed by light washing from the utensils: little scrubbing is required as mere rinsing or light rubbing with a sponge or cloth removes all food soil. These pretreating compositions even loosen and remove burned-on, dried or cooled food substances, including those such as chocolate and tomato sauce that are known as difficult to remove.

U.S. Pat. No. 4,105,574 (Culmone) and U.S. Pat. No. 4,372,788 (Lancz) describe "grill" and "oven" cleaners based on monoethanolamine. U.S. Pat. No. 4,056,113 (Johnson et al.) and U.S. Pat. No. 4,268,406 (O'Brien et al.) describe liquid dishwashing detergent compositions containing free monoethanolamine and which are noted to be particularly suited for removing cooked-on foods from cooking utensils.

These compositions are usually applied directly to the soiled area of the utensil without dilution. Filling a pot or pan with water before or after adding the pretreater will usually reduce the effectiveness of the cleaner.

A common problem with these pretreating products, however, is that they stain cooking and eating utensils which contain aluminum. It has been estimated that 10% of flatware and around 50% of pots and pans contain aluminum. The usefulness of these pretreating compositions is reduced by the large black expanses, the numerous irregular black patches or the many tiny black dots with which pretreaters may stain a utensil.

The alkalinity of the pretreating compositions causes the stains or discoloring. Alkalinity though is very desirable in these products for soaking into burned-on or dried food and loosening the same from pans or utensils.

To preserve the alkalinity of pretreating products but avoid staining utensils, several anti-stain agents such as colloidal and fumed silicas have been tried. Colloidal silicas did not prevent staining by the high electrolyte pretreating composition because they caused agglomeration and instability. Various fumed silicas were more successful: low levels of fumed silicas did prevent staining at full strength but these silicas were of limited usefulness. Diluted to less than 10% strength, the composition with fumed silica no longer prevented staining. This is deemed a serious defect due to the practice of many consumers of mixing pretreating compositions with liberal amounts of water. Further work with fumed silicas failed to overcome the problem of aluminum staining from dilute solutions. Silicates are not generally effective in formulations and conditions of medium alkalinity (pH $<11$) due to tendency to deposit hard-to-remove silica-containing precipitates.

PRIOR ART

A survey of the prior art reveals documentation of a variety of approaches to solve the problem of aluminium staining. GB 849,747 (Unilever) discusses the inclusion of elements from Group IVB of the periodic table. U.S. Pat. No. 4,229,409 (Scharf et al.) suggests that corrosion of aluminium in alkaline solutions may be inhibited by the addition of 2-phosphono-butane-1,2,4 tricarboxylic acid or salts thereof. U.S. Pat. No. 4,276,089 (Moran) describes anti-corrosion agents containing a particular class of polyamine and at least one alkylenephosphonic acid derivative. U.S. Pat. No. 4,018,702 (Boffardi et al.) concerns the use of corrosion inhibitors comprising amine adducts of polymaleic anhydride together with zinc to inhibit the corrosion of metallic surfaces of aqueous systems. Zinc is present as the zinc ion. Thiazols may be used as co-inhibitors. U.S. Pat. No. 4,435,303 (Abadi) describes scale removing systems including an anionic surfactant, a nonionic surfactant, an ethanolamine, zinc and hydroxyacetic acid.

SUMMARY OF THE INVENTION

A new liquid cleaning composition has been found to have many attractive qualities and to present significant improvements over known compositions. The new composition, which is effective in pretreating eating and cooking utensils, comprises 1–10% organic base, 0.1–4% zinc salt, 0.1–10% complexing agent, 0.1–30% surfactant and balance solvent.

The composition eliminates staining of aluminum from alkaline substances. The zinc ions form an association complex with several complexing agents and, depending on the complexing agent, several water molecules. This association complex is dissolved in the composition and remains so over long term storage. Thus, the stain-prevention characteristic is not noticeably reduced during the life of the composition.

The composition may be applied directly to utensils at full strength; or the composition may be diluted, as pretreaters and dishwashing detergents commonly are, with water. At 5–10% dilution, (i.e. 95–90 parts water, 5–10 parts product) the pretreater may give the aqueous solution an alkaline pH, e.g. 8–9.5, which may suffice to stain aluminum or aluminum-containing utensils. However, it is a remarkable trait of the pretreater composition that at dilutions as low as 5–10%, the zinc association complex still reduces or prevents staining. It is this dual effectiveness, i.e. at full strength and at dilution which confers benefit upon the instant invention.

The zinc association complex may be augmented by further compounds to prevent aluminum staining. These include azole compounds such as triazoles, thiazoles and oxazoles.

DETAILED DESCRIPTION OF THE INVENTION

The composition of the present invention comprises 1–10% of an organic base, 0.1–4% of a water-soluble zinc salt, 0.1–10% of a complexing agent, 0.1–30% of a surfactant and the balance, solvent. All percentage amounts herein indicate percent by weight unless otherwise noted.

The organic base is a source of alkalinity for the composition. Amines are particularly suitable. Such suitable amines have a pKa greater than about 9 and include monoethanolamine, pyrrolidine, n-butyl amine, s-butyl amine, 4-amino-1-butanol, 6-amino-1-hexanol, t-butylamine, cyclohexylamine, piperidine, trimethylenediamine, 1,6-diaminohexane, ethylene diamine, 2,6-dimethylpiperidine, 2-amino-1-butanol, benzylamine, N-benzylmethylamine, glucosamine, and 3-amino-1-propanol. Monoethanolamine, 1,6-diaminohexane and 2-(2-aminoethoxy) ethanol are preferred for incorporation in the present invention as they impart little or no unpleasant odor to the light duty composition. The organic base may be present at from 1–10%, preferably from about 2 to about 4% by weight.

The composition further comprises a water-soluble zinc salt present in an amount from 0.1–4.0%, preferably 1–3.5%. The zinc salt may be any salt which is substantially water-soluble at 20° C. and may have an organic or inorganic anion. Suitable inorganic salts include the soluble zinc halides, zinc sulfate, and zinc nitrate; suitable organic salts include zinc formate and zinc acetate.

The complexing agent incorporated in the composition may be any of a wide variety of compounds, including ammonia, monoethanolamine, EDTA, NTA, citrate ether polycarboxylates such as carboxymethyloxysuccinates and oxydisuccinates, aminophosphonates and soluble amino acids. The amino acids include not only the optical isomers but also racemic mixtures thereof. Suitable amino acids include leucine, serine, histidine, tryptophan, tyrosine, valine, aspartic acid and glutamic acid. Certain amino acids may be found to complex with zinc and form precipitates. These are not included within the scope of the invention. The complexing agent may be present at from 0.1 to about 10%, preferably from 1–5% and most preferably from 0.5–2%.

Zinc ion association complexes which are synthesized prior to dispersion in the composition solvent may also be used. Given the greater expense of these synthesized complexes, it is usually preferred to add zinc salt to complexing agent to obtain the desired zinc association complex.

The complex formed by zinc with organic base however does not usually survive elevated temperatures (105° F.) or storage over time (6 weeks) but tends to precipitate zinc hydroxide. Thus, compositions having a zinc ion complexed exclusively with an organic base e.g. monoethanolomine have a relatively short shelf life.

On the other hand, zinc complexes with EDTA, NTA, citrate and Dequest 2000 and 2066 (aminotri (methylene phosphonates) and diethylenetriaminepenta(methylene phosphonates) do not precipitate out and have stability over time and at elevated temperatures superior to that of zinc:organic base complexes. Moreover, alkaline compositions incorporating these complexes have reduced or no aluminum staining. However, soil removal by these formulations is significantly inferior to that of the same formulation without the zinc complex if too high a level is used, e.g. greater than about 2%.

Further testing revealed that zinc in combination with certain amino acids in the alkaline cleaner base forms a stable, soluble complex which does not agglomerate or destabilize the composition; does not precipitate out over time if subjected to temperatures of 105° F.; and which does lessen or prevent aluminum staining. The molar ratio of zinc to amino acid may be from about 1:1 to 1:5.

The composition still further comprises an anionic surfactant component. A wide variety of compounds is suitable for use in the present invention, including sulfonated and sulfated surfactants containing a $C_{10}$-$C_{16}$ alkyl or alkenyl group, such as long chain ($C_{12}$-$C_{18}$) fatty alcohol sulphates, or sulfated ethoxylated long chain ($C_{12}$-$C_{18}$) alcohols; and long chain ($C_{12}$-$C_{18}$) alkylamino and alkylamido sulphonates, e.g., N-$C_{10}$-$C_{16}$ alkyl-N-methyl taurates and N-$C_{12}$-$C_{16}$ fatty acyl-N-methyl taurates. Also suitable would be carboxylated long chain ($C_{12}$-$C_{18}$) alcohol ethoxylates.

Other suitable sulfonate surfactants are the water-soluble salts, particularly the alkali metal, and alkanolammonium (e.g., monoethanolammonium or triethanolammonium) salts of alkylbenzene sulfonates in which the alkyl group contains from about 10 to about 15 carbon atoms, in straight chain or branched chain configuration. Especially valuable are linear straight chain alkylbenzene sulfonates in which the average number of carbon atoms in the alkyl group is from about 11 to about 13.

Also useful herein are the water-soluble salts of paraffin sulfonates, alkyl glyceryl ether sulfonates, and β-alkyloxy alkane sulfonates containing from about 1 to 3 carbon atoms in the alkyl group.

Mixtures of the above-described sulfonates, particularly with the $C_{11-13}$ linear alkylbenzene sulfonates, can also be used.

Additional anionic surfactants useful in the present invention are various complex organic phosphate ester surfactants, e.g. esters of α-phosphated fatty acids, β-alkyloxy alkane phosphates, and esters having formula (I) or (II):

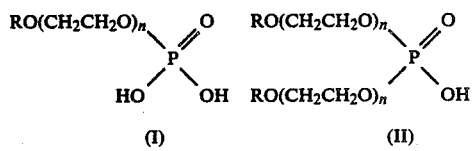

(I) (II)

where n is an integer from 0 to 25 and R is an alkyl group of 3–18 carbon atoms or a phenyl group. Alkali metal or ammonium or substituted ammonium salts of these complex organic phosphate esters are suitable, as are mixtures of the esters, for use in the cleaning composition.

Commercially available examples of these anionic surfactants are surfactants sold under the trade names Neodol 23-3S (a mixture of sulfated primary alcohols having 12 and 13 carbon atoms condensed with 3 moles of ethylene oxide) produced by Shell Oil Company, Houston, Tex.; and GAFAC LO-529 and GAFAC RM-510, respectively believed to be a partial sodium salt and a free acid form of organic phosphate ester of the compound having Formula (I) produced by GAF Corporation, New York, N. Y.

Also useful as anionic surfactants are the sulphosuccinates, particularly dialkyl sulphosuccinates.

The anionic surfactant may be present at from 0.2–4%, preferably 0.4–2%, most preferably 0.5–1.5%.

The solvent of the composition is usually water, which may be demineralized by procedures known in the art.

Among the additional components which may be incorporated in the present composition are nonionic surfactants, organic solvents, additional anti-stain agents, and viscosity control agents.

Many nonionic surfactants can be utilized in the cleaning compositions of this invention. The surfactant provides a penetrating and wetting effect, so as to increase the rate at which the composition penetrates food soil. Generally, the classes of nonionic surfactants which have been found to be most effective at the above-mentioned concentration levels include the following:

(a) ethoxylated linear primary alcohols having the general formula $$C_mH_{2m+1}O(CH_2CH_2O)_nH \quad \text{(III)}$$

where m is 12 to 15, where n is 0.5 to 8.0. Mixtures of these alcohols are also effective in the present composition, e.g. a mixture of primary alcohols with 12 to 13 carbon atoms condensed with 3 moles of ethylene oxide, available commercially as Neodol 23-3 ® ex Shell Oil Company.

(b) ethoxylated linear secondary alcohols having the general formula $$CH_3(CH_2)_mCH(CH_2)_pCH_3 \quad \text{(IV)}$$
$$\quad\quad\quad\quad | \quad\quad\quad\quad$$
$$\quad\quad\quad\quad O-(CH_2CH_2O)_nH$$

where the sum of m and p is 6 to 13 and n indicating the moles of ethylene oxide may be 0.5 to 8. Mixtures of these secondary alcohols are also suitable for the composition, e.g. a mixture of linear secondary alcohols having 11–15 carbon atoms condensed with three moles of ethylene oxide, available commercially under the trade name Tergitol 15-S-3 ex Union Carbide Company of Danbury, Conn.

(c) ethoxylated alkyl phenols having the general formula

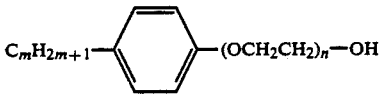

(V)

where m is at least 8, and n is at least 3.

Special mention must also be made of alkylpolyglycosides such as are disclosed in European Pat. Nos. 0,070,074; 0,070,075,0,070,076; and 0,092,877.

The amount of nonionic surfactant in the composition may be 0.5–10%, or 1–9% or 2–6%.

There may be an alcohol added to the water to help dissolve the components of the composition. Suitable alcohols include methanol, ethanol, and propanol, or a mixture of one or more of these alcohols. One alcohol which is commercially available is 3A-Alcohol Regular, comprising ethanol and methanol in a 95:5 ratio, also known as denatured alcohol or industrial methylated spirits. These alcohols may be present at 3–10% by weight and more particularly 5–8%.

Polyols such as propylene glycol and hydrogenated glucose syrups may also be added to the compositions to improve solvent properties. Preferred is Lonza's Hystar 8070, a hydrogenated glucose syrup.

Other organic solvents for aiding in the dissolution of oils and grease can include, individually or as mixtures, lower alkylene glycols (e.g. ethylene glycol, propylene glycol, butanediols, hexamethyleneglycol, etc.) and the glycol ethers (e.g. glycol monoethyl ether, glycol monobutyl ether, diethyleneglycol monoethyl ether diethylene glycol butyl ether). One commercially available product comprising propylene glycol ethers which is compatible with the present composition is Dowanol BC 100 ex Dow Chemical Company of Midland, Mich.

The grease solvent may comprise B-25% or 10–22% of the cleaning composition.

The additional anti-stain agents are various azole compounds (thiazoles, triazoles, oxazoles, etc.). The use of benzotriazoles as inhibitors of corrosion in systems having pH 8–11, possibly in dishwashing compositions, has been described in U.S. Pat. No. 3,245,915 (Rat et al.), whilst the co-use of thiazoles and alkali metal nitrites as corrosion inhibitors is described in U.S. Pat. No. 4,098,720 (Hwa). Benzotriazole was found to be particularly effective in combination with the zinc association complexes. Other compounds such as mercaptobenzothiazole, mercaptobenzimidazole, imidazole and mercaptobenzoxazole were found to be less effective in stain prevention. These additional anti-stain agents may be present at levels of 0.005–0.2% of the composition.

The composition may be made by mixing the components sequentially into the solvent component. For the most part, the order of component addition is not critical. However, in mixing the zinc salt and complexing agent, the following procedures have been found advantageous.

The components of the zinc complex may be dissolved in the solvent medium (usually water) simultaneously or in any order. However, it has been found advantageous and preferred to dissolve the ligand in water and thereafter to add the zinc, usually in the form of a water-soluble salt, to the medium and thereafter to add an required alkali metal hydroxide for pH adjustment.

It has been found particularly advantageous to disperse the ligand either in the acidic form (e.g., as an organophosphonic acid) or in the alkali metal salt form and to add to the resulting solution the divalent metal, in the form of a water-soluble salt of the divalent metal. Alternatively, the ligand, in the acid form, may be dissolved in water, the zinc salt added to the solution and thereafter the alkali metal hydroxide added for pH adjustment. The anions of the zinc salts are preferably non-oxidizing anions such as for example sulfate, chloride, citrate, or acetate anions.

Generally speaking the amount of complex is based upon the amount of metal employed and the metal complex is usually present in an amount which is sufficient to provide from about 1% to about 5% by weight, based on the weight of the formulation, of metal in the form of metal ion. Such metal complexes are usually substantially soluble under these circumstances.

The aqueous alkaline medium comprising an aqueous alkaline solution of any of the aforementioned complexes may contain in addition to the complexes, an excess of ligand and from a practical standpoint it has sometimes been found more advantageous to have an excess of ligand in terms of a metal to ligand mol ratio of 1:2 or higher, e.g. up to 1:5. Thus, at a mol ratio of 1:1 the aqueous medium may consist substantially of metal ions which are entirely complexed with the ligand. When the mol ratio is from just above 1:1 to about 1:2 excess ligand may be present in the medium. A ratio of 1:2 is preferred.

For a fuller understanding of the present invention, reference may be made to the following examples.

EXAMPLE 1

Experiments were carried out to examine corrosion inhibition by zinc complexes in an LDL (light duty liquid) base containing 2% monoethanolamine (MEA). The LDL base, which is used in all subsequent examples (although the percentage of MEA may vary) was made up as follows:

| COMPONENT | % IN FORMULA |
|---|---|
| Water | Balance to 100 |
| Polyol Hystar 8070 | 3.75 |
| Sodium Xylene Sulfonate | 9.0 |
| Monoethanolammonium Salt of Alkylbenzene Sulfonic Acid | 3.5 |
| Sodium Salt of Alkylbenzene Sulfonic Acid | 14.0 |
| Neodol 23-3S | 12.0 |
| Lauric/Myristic monoethanolamide | 4.0 |
| Monoethanolamine | 2.0 |

The tests were carried out by contacting the solution under investigation for 30 minutes with a cleaned 7075 aluminum* tile. The degree of staining was estimated visually.

*An aluminum alloy commonly used for panware.

The zinc complex was derived from 3% zinc acetate $2H_2O$ and the corresponding level of complexing agent.

Tests were carried out using the solutions at full (concentrated) strength and at various dilutions.

| | DEGREE OF STAINING OBSERVED | | | |
|---|---|---|---|---|
| COMPLEX | Conc. | 50% | 10% | 1% |
| Zinc/citrate (1:1 molar) | None | None | Slight | None |
| Zinc/EDTA (1:1) | Slight | Slight | Moderate | Moderate |
| Zinc/NTA (1:1) | Slight | Slight | Moderate | Moderate |
| Zinc/Dequest 2066 (1:1) | None | None | None | None |
| Control (no inhibitor) | Trace | Moderate | Moderate | Heavy |

In comparison to the control, the use of a solution further comprising a zinc complex results in reduced straining, particularly at low concentration. A zinc/Dequest complex shows particularly beneficial results, as straining at high and low concentrations is not observed.

EXAMPLE 2

The effect of zinc/amino acid complexes was investigated. A 3% MEA LDL base was used at 10% dilution.

The test protocol of Example 1 was followed, except that the degree of corrosion inhibition after 60 minutes was observed.

| COMPLEX | COMMENTS |
|---|---|
| Zinc/B-alanine (1:1 and 1:2) | Unstable - precipitates |
| Zinc/Proline (1:1) | Unstable |
| Zinc/Proline (1:2) | Partial inhibition |
| Zinc/dl-Leucine (1:2) | Insoluble |
| Zinc/dl-Serine (1:2) | Partial inhibition |
| Zinc/Threonine (1:2) | Some inhibition |
| Zinc/Methionine (1:2) | Insoluble |
| Zinc/Phenylalanine (1:2) | Precipitates |
| Zinc/dl-Histidine (1:2) | Insoluble |
| Zinc/dl-Tryptophan (1:2) | Insoluble |
| Zinc/dl-Tyrosine (1:2) | Insoluble |
| Zinc/dl-Valine (1:2) | Insoluble |
| Zinc/Cysteine (1:2) | Slight Staining |
| Zinc/l-Arginine (1:2) | Complete Inhibition |
| Zinc/Glycine (1:2) | Slight Staining |
| Zinc/Lysine (1:2) | Slight Staining |

EXAMPLE 3

The effect of adding small amounts of benzotriazole to an LDL pretreater base containing 2% MEA was investigated using the previously described regime. The material was evaluated alone and in combination with the components of the zinc/glycine inhibitor system.

| LDL Pretreater With: | Results |
|---|---|
| Glycine alone | Staining |
| Benzotriazole alone | Staining |
| Glycine/Benzotriazole | Staining |
| Zinc/Glycine | Near Complete Inhibition |
| Zinc Benzotriazole | Partial Inhibition |
| Zinc/Glycine/Benzotriazole | Complete Inhibition |

Additional tests were carried out to establish minimum effective levels of zinc/glycine and benzotriazole necessary for complete inhibition of corrosion in a 2% MEA LDL pretreatment composition. Aluminum panels were contacted for 30 minutes using products at full strength, 50%, 10% and 1% solutions.

Based on these results, additional work was done to establish minimum effective levels of zinc/glycine and benzotriazole necessary for complete inhibition of corrosion in a 2% MEA LDL pretreater. Again, staining tests were run on aluminum panels with 30 minute contact time using products at full strength, 50%, 10% and 1% solutions. Results can be summarized as follows:

(1) With 1:2 molar zinc/glycine derived from 3% zinc acetate $.2H_2O$, complete inhibition of corrosion is obtained with as little as 0.05% benzotriazole.

With benzotriazole held constant at 0.2%, complete inhibition of corrosion is obtained with as little as 1% zinc acetate $.2H_2O$ as the corresponding 1:2 molar zinc/glycine complex.

In combination, complete inhibition can be obtained with as little as 0.05% benzotriazole in conjunction with 1.25% zinc acetate . $2H_2O$ as the corresponding 1:2 molar zinc/glycine complex.

Lysine showed comparable to superior results in comparison to Glycine.

EXAMPLE 4

A study of staining vs. pH was carried out on a zinc/-Lysine/ benzotriazole inhibitor system in order to determine pH limits. Staining tests were run on aluminum plates for 60 minutes at full strength, 50%, 10%, 1% and 0.15% concentrations. The pH of the various test compositions was adjusted to 10.5, 10.7, 10.9, 11.1 and 11.3.

The test results may be summarized as follows:

(1) A 1:2 zinc/lysine complex derived from 0.5% zinc acetate. $2H_2O$ in the presence of 0.05% benzotriazole shows no significant staining up to and including pH 10.9.

(2) A 1:2 zinc/lysine complex derived from 1.0% zinc acetate $\cdot 2H_2O$ in the presence of 0.05% benzotriazole shows no significant staining up to and including ph 10.9 and only trace staining at pH 11.1 and 11.3.

EXAMPLE 5

The following two formulations were prepared.

| Ingredient | A (wt. %) | B (wt. %) |
|---|---|---|
| Na $C_{11}$ Alkybenzene Sulfonic Acid | 5.5 | 14.0 |
| Monoethanol ammonium salt of $C_{11}$ ABS | 3.25 | 3.5 |
| Na $C_{12-13}$ Alkylethoxy (3EO) Sulfate | 3.5 | 12.0 |

-continued

| Ingredient | A (wt. %) | B (wt. %) |
|---|---|---|
| $C_9$–$C_{11}$ Alcohol Ethoxylate (8EO) | 3.5 | — |
| Lauric Monoethanolamide | 1.5 | 3.0 |
| Monoethanolamine | 4.0 | 3.0 |
| Na Citrate | 2.0 | — |
| Zinc Acetate (dihydrate) | 1.0 | 1.0 |
| Dequest 2066 | 1.6 | 1.6 |
| Hystar 8070 | 8.75 | 8.75 |
| Na Xylene Sulfonate | 3.0 | 5.0 |
| Water | to 100 | |
| Total Surfactant | 17.25% | 32.5% |

Cleaning performance of the test compositions A and B was evaluated in comparison to a commercially available light-duty liquid not containing monoethanolamine (Sunlight, ex Lever Bros.—"Composition C").

Tests were carried out using three soil sample types:

(1) A fat-flour mixture baked onto aluminum tiles as described in Example 5.

(2) A meat/milk/flour mixture baked onto a pyre tile. The mix was spread onto tiles and baked for 25 minutes at 95° C.

The soil was:

164 g ground meat
19 g egg
31 g bread
25 g skim milk
15 oz. meat gravy

Mixture was blended before application.

(3) A milk/egg mixture (2 eggs, 2 tbls milk) baked onto an aluminum pan.

Soil removal was tested by soaking the sample, then wiping with a semi-abrasive sponge whilst rinsing.

Results

| Test Soil | Product Conc. (%) | Soak (Min.) | % Removal A | B | C |
|---|---|---|---|---|---|
| Fat/flour (Al) | 50 | 15 | 100 | 80 | 0 |
| | 25 | 15 | 50 | 50 | 0 |
| | 25 | 30 | 75 | 75 | 0 |
| Milk/Meat/Flour (pyrex) | 50 | 15 | 100 | 100 | 25 |
| | 10 | 30 | 100 | 100 | 60 |
| | 2 | 30 | 100 | 100 | 80 |
| Milk/egg (Al) | 50 | 15 | 100 | 100 | 35 |

EXAMPLE 6

The cleaning performance of 3% MEA LDL's containing various inhibitor systems was evaluated.

The evaluation was carried out by coating aluminum tiles with a mixture containing 2 parts Crisco® vegetable shortening and 1 part Pillsbury® all-purpose flour. The mixture is applied to an aluminum tile with a brush and baked for 40 minutes at 400° F. After baking and cooling, a second coat of fat/flour is applied and the tile baked again for 40 minutes at 400° F.

Cleaning performance was evaluated on a scale of 0–4, where 0 indicates no soil removal, 4 indicates complete removal.

| INHIBITOR SYSTEM (levels wt. %) | CLEANING PERFORMANCE Full Strength | 50% | 10% | 1% |
|---|---|---|---|---|
| 0.5% zinc acetate/0.8% Arginine/0.05% Benzotriazole | 0 | 4 | 0 | 0 |
| 0.5% zinc acetate/1.6% Lysine/ 0.05% Benzotriazole | 0.5 | 3 | 0 | 0 |
| 0.5% zinc acetate/0.33% Glycine | 1.0 | 3.5 | 0 | 0 |
| 1.5% zinc acetate/2.8% Dequest 2066 | 0 | 0 | 0 | 0 |
| Control (No Inhibitor) | 1.5 | 4 | 0 | 0 |

The poor results obtained with the relatively high levels of Dequest 2066 are in contrast to the effective cleaning obtained with a lower level of Dequest 2066 in Example 5 and indicate that for good cleaning the level of Dequest used must be carefully regulated.

What is claimed is:

1. A cleaning composition comprising:
(a) 1–10% of an amine having a pKa greater than 9;
(b) 0.1–4% of a zinc salt selected from the group consisting of zinc halides, zinc sulfate, zinc nitrate, and organic salts of zinc;
(c) 0.1–10% of a complexing agent which is glycine;
(d) 0.2–30% of an anionic surfactant;
(e) 0.005–0.2% of benzotriazole, oxazoles and triazoles; and
(f) water, the composition having a pH of 9–11.

2. The composition according to claim 1 further comprising 8–25% of a polyol.

3. A method of cleaning a soiled aluminum surface without causing significant corrosion thereof which comprises applying to said surface a cleaning composition or aqueous solution thereof, said composition comprising:
(a) 1–10% of an amine having a pKa greater than 9,
(b) 0.1–4% of a zinc salt, selected from the group consisting of zinc halides, zinc sulphate, zinc nitrate and organic salts of zinc,
(c) 0.1–10% of a complexing agent which is glycine,
(d) 0.2–30% of an anionic surfactant,
(e) 0.005–0.2% of benzotriazole; and
(f) water,
the composition having a pH of 9–11, and thereafter rinsing said surface.

4. The composition according to claim 1 further comprising 0.5–10% of a nonionic surfactant.

* * * * *